US009127433B2

(12) United States Patent
Kloster et al.

(10) Patent No.: US 9,127,433 B2
(45) Date of Patent: Sep. 8, 2015

(54) FORMWORK ELEMENT

(71) Applicant: SIKA TECHNOLOGY AG, Baar (CH)

(72) Inventors: Magnus Kloster, Dietenheim (DE); Klaus Meyer, Ratingen (DE); Ulrich K. Weber, Dubai (AE)

(73) Assignee: SIKA TECHNOLOGY AG, Baar (CH)

( * ) Notice: Subject to any disclaimer, the term of this patent is extended or adjusted under 35 U.S.C. 154(b) by 0 days.

(21) Appl. No.: 13/918,231

(22) Filed: Jun. 14, 2013

(65) Prior Publication Data

US 2013/0279991 A1 Oct. 24, 2013

Related U.S. Application Data

(63) Continuation of application No. PCT/EP2011/072766, filed on Dec. 14, 2011.

(30) Foreign Application Priority Data

Dec. 17, 2010 (EP) ..... 10195626

(51) Int. Cl.
*E02D 31/02* (2006.01)
*E02D 29/16* (2006.01)
*E02D 31/04* (2006.01)

(52) U.S. Cl.
CPC ..... *E02D 31/02* (2013.01); *E02D 29/16* (2013.01); *E02D 31/04* (2013.01)

(58) Field of Classification Search
CPC ..... E02D 5/20; E02D 27/42; E04H 12/2292; B05D 5/08; B28B 7/384
USPC ..... 405/232, 233, 229, 231, 237, 238, 239, 405/248, 251, 252, 256, 257; 52/835; 249/48, 51
See application file for complete search history.

(56) References Cited

U.S. PATENT DOCUMENTS 892,592 A * 7/1908 Helm et al. ..... 249/51
1,409,422 A * 3/1922 Squire et al. ..... 405/216
(Continued)

FOREIGN PATENT DOCUMENTS

DE 27 34 525 A1 2/1979
DE 10 2006 059044 A1 6/2008
(Continued)

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) issued on Jun. 27, 2013, in the corresponding International Application No. PCT/EP2011/072766. (7 pages).
(Continued)

*Primary Examiner* — Tara M. Pinnock
(74) *Attorney, Agent, or Firm* — Buchanan Ingersoll & Rooney PC

(57) ABSTRACT

A method for sealing piles in foundations in the construction field, wherein a hollow-body formwork element is used. The method includes: 1) applying a barrier layer to the foundation; 2) introducing a pile into the foundation, the pile being arranged so as to penetrate the barrier layer; 3) applying a hollow-body formwork element along the central longitudinal axis of the pile, the hollow-body formwork element surrounding the pile; 4) introducing mineral binding agents into the intermediate space between the pile and the hollow-body formwork element; 5) connecting the barrier layer and the hollow-body formwork element. The hollow-body formwork element has on the side facing the pile a contact layer, which includes a composite layer of a porous material and/or a sealant. The hollow-body formwork element can remain as a part of the structure and thus can perform a sealing function.

23 Claims, 4 Drawing Sheets

(56) References Cited

U.S. PATENT DOCUMENTS

| | | | | | |
|---|---|---|---|---|---|
| 2,428,070 | A | * | 9/1947 | Frenkil | 405/216 |
| 3,166,871 | A | * | 1/1965 | Simison | 206/321 |
| 3,757,528 | A | * | 9/1973 | Finsterwalder et al. | 405/239 |
| 4,019,301 | A | * | 4/1977 | Fox | 52/834 |
| 4,767,095 | A | * | 8/1988 | Fitzgerald et al. | 249/48 |
| 5,175,973 | A | * | 1/1993 | Owen et al. | 52/741.14 |
| 5,542,229 | A | * | 8/1996 | Saito et al. | 52/835 |
| 5,890,844 | A | * | 4/1999 | Schellhorn | 405/267 |
| 5,915,884 | A | * | 6/1999 | Gates et al. | 405/232 |
| 7,192,219 | B2 | * | 3/2007 | Graziosi | 405/229 |
| 2002/0031405 | A1 | * | 3/2002 | Queen et al. | 405/249 |
| 2011/0176876 | A1 | | 7/2011 | Scuero | |
| 2011/0197427 | A1 | | 8/2011 | Weber et al. | |

FOREIGN PATENT DOCUMENTS

| | | | | |
|---|---|---|---|---|
| EP | 2 177 349 | A1 | | 4/2010 |
| JP | 2005-194768 | A | * | 7/2005 |
| WO | WO 2010/028766 | A1 | | 3/2010 |

OTHER PUBLICATIONS

International Search Report (PCT/ISA/210) issued on May 2, 2012, by the European Patent Office as the International Searching Authority for International Application No. PCT/EP2011/072766.

Written Opinion (PCT/ISA/237) issued on May 2, 2012, by the European Patent Office as the International Searching Authority for International Application No. PCT/EP2011/072766.

* cited by examiner

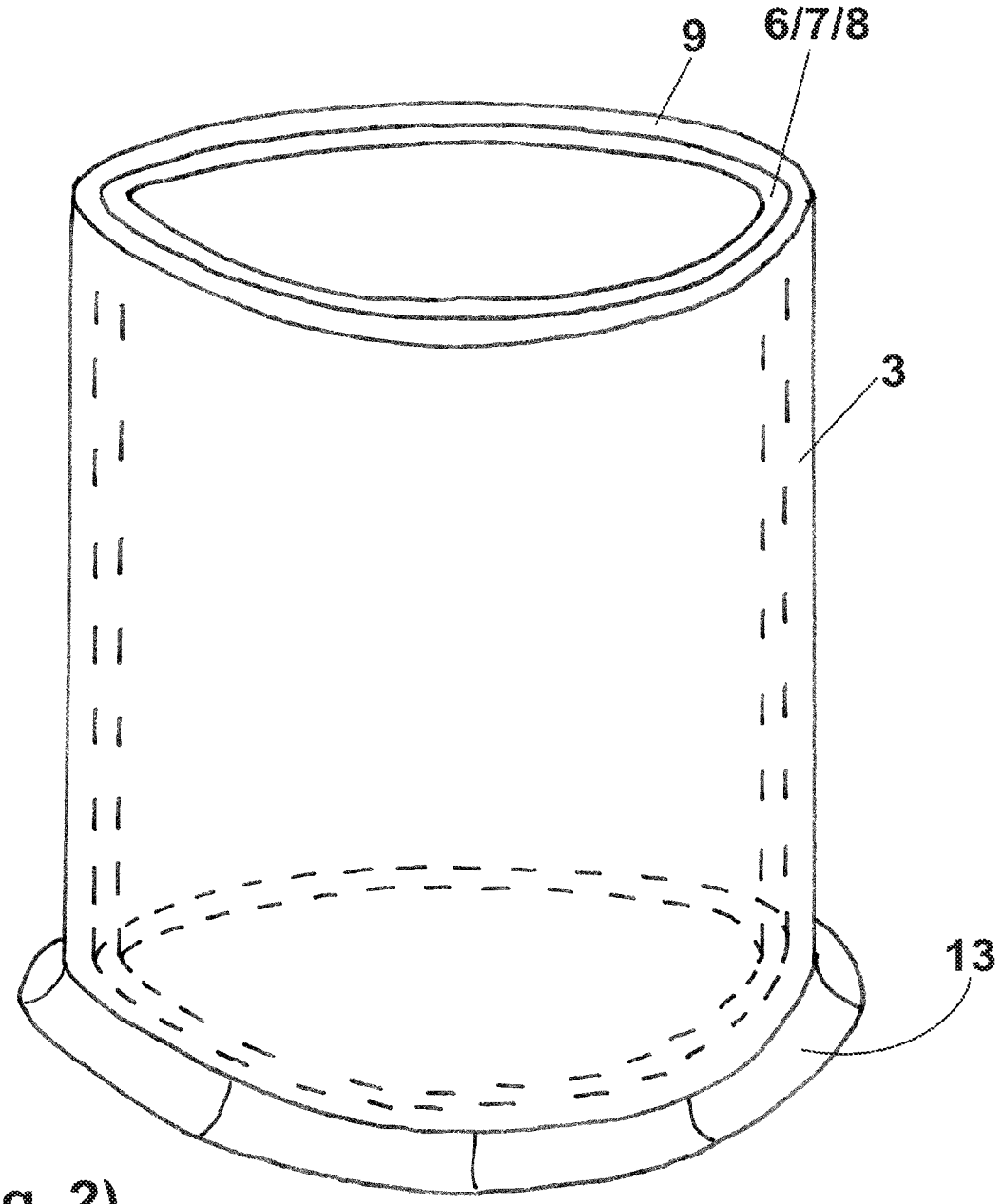
Fig. 2)

FORMWORK ELEMENT

RELATED APPLICATION(S)

This application claims priority as a continuation application under 35 U.S.C. §120 to PCT/EP2011/072766, which was filed as an International Application on Dec. 14, 2011 designating the U.S., and which claims priority to European Application No. 10195626.6 filed in Europe on Dec. 17, 2010. The entire contents of these applications are hereby incorporated by reference in their entireties.

FIELD

The present disclosure pertains to a method for sealing an opening in a geomembrane, for example, associated with a pile in the construction field.

Although applicable to any given field of construction, the present disclosure and issues concerned with it are explained below in regard to an exemplary bored pile.

BACKGROUND INFORMATION

Bored piles are used, for example, for foundations, for example, in soft foundations. For their production, a borehole can be made with the desired depth and a bored pile can be introduced into the borehole or the bored pile can be driven at once directly into the foundation.

When building a concrete structure, the foundation can be covered with a geomembrane to prevent water from getting into the structure from the foundation.

The bored piles can be joined directly or indirectly to the structure, for which openings are punched in the geomembrane. This creates an area through which moisture can get into the structure from the foundation between the geomembrane and the bored pile in the area of the opening.

SUMMARY

According to an exemplary aspect, a method is provided for sealing a pile in a foundation in a construction field by using a hollow-body formwork element, the method comprising: applying a barrier layer to a foundation; introducing a pile into the foundation, the pile being arranged so as to penetrate the barrier layer; applying a hollow-body formwork element along the central longitudinal axis of the pile, the hollow-body formwork element surrounding at least a part of the pile; introducing a mineral binding agent into an intermediate space between the pile and the hollow-body formwork element; and connecting the barrier layer and the hollow-body formwork element; wherein the hollow-body formwork element has on a side facing the pile a contact layer which comprises a composite layer of a porous material and/or a sealant.

BRIEF DESCRIPTION OF THE DRAWINGS

Exemplary embodiments of the disclosure are explained by means of the drawings.

FIG. 2 shows a lateral front view of a hollow-body formwork element, according to an exemplary aspect.

DETAILED DESCRIPTION

According to an exemplary aspect, a method is provided for limiting or preventing moisture from the foundation from getting in between the geomembrane and the bored pile in the area of the opening.

According to an exemplary aspect, disclosed is a method for sealing piles in foundations in the construction field by using a hollow-body formwork element. The method comprises:

1) applying a barrier layer to the foundation;
2) introducing a pile into the foundation, the pile being arranged so as to penetrate the barrier layer;
3) applying a hollow-body formwork element along the central longitudinal axis of the pile, the hollow-body formwork element surrounding the pile;
4) introducing mineral binding agents into the intermediate space between the pile and the hollow-body formwork element;
5) connecting the barrier layer and the hollow-body formwork element.

The hollow-body formwork element has on the side facing the pile a contact layer, which comprises a composite layer of a porous material and/or a sealant.

For example, the introduced mineral binder can bind substantially firmly to the contact layer and thereby reduce or prevent moisture from the foundation getting in behind the hollow-body formwork element.

For example, with an exemplary method one can eliminate the removal of the formwork and thus an additional work step, since the hollow-body formwork element remains as part of the structure and thus performs a sealing function.

Figure 1A:
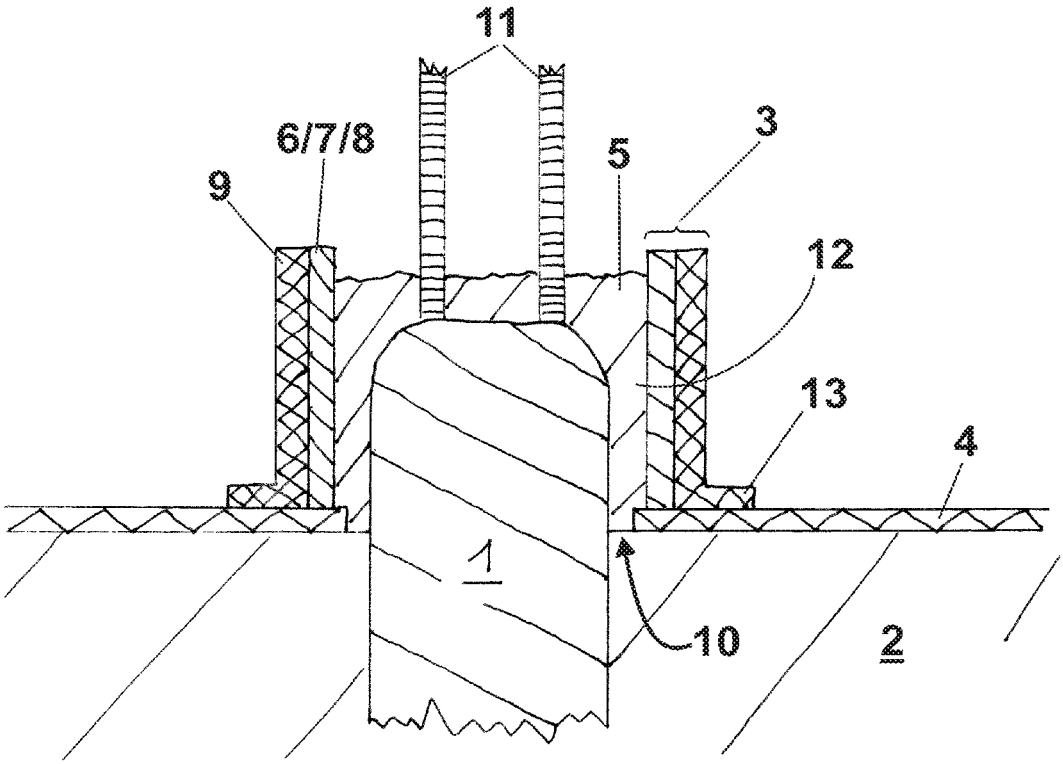
FIGS. 1*a*, 1*b* and 1*c* show a lateral cross section through a sealed pile, according to an exemplary aspect.
Figure 1B:
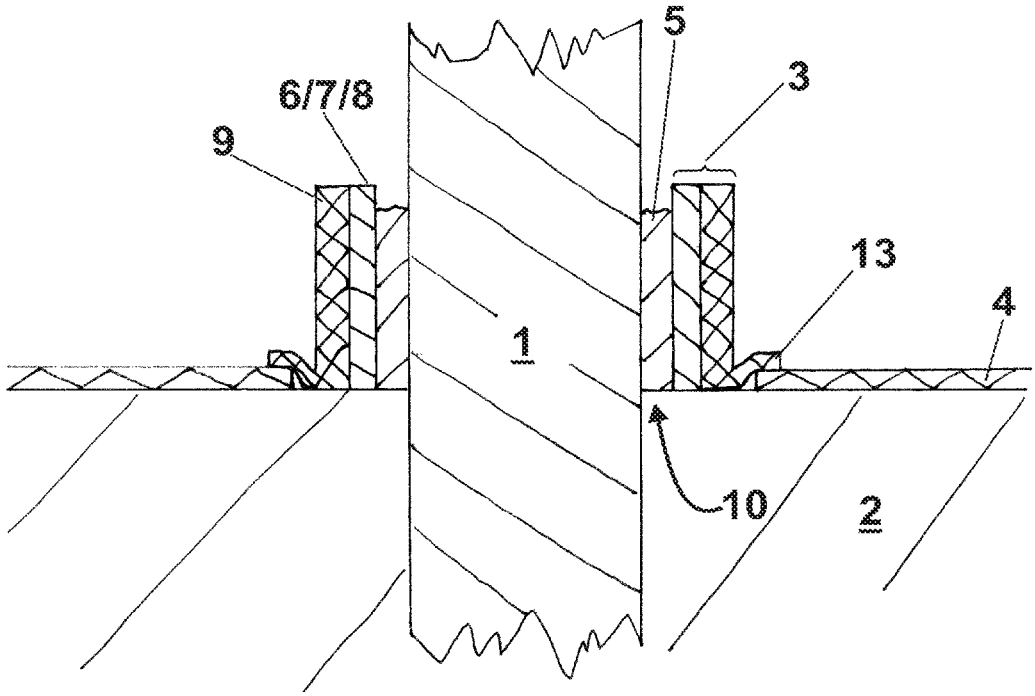
Figure 1C:
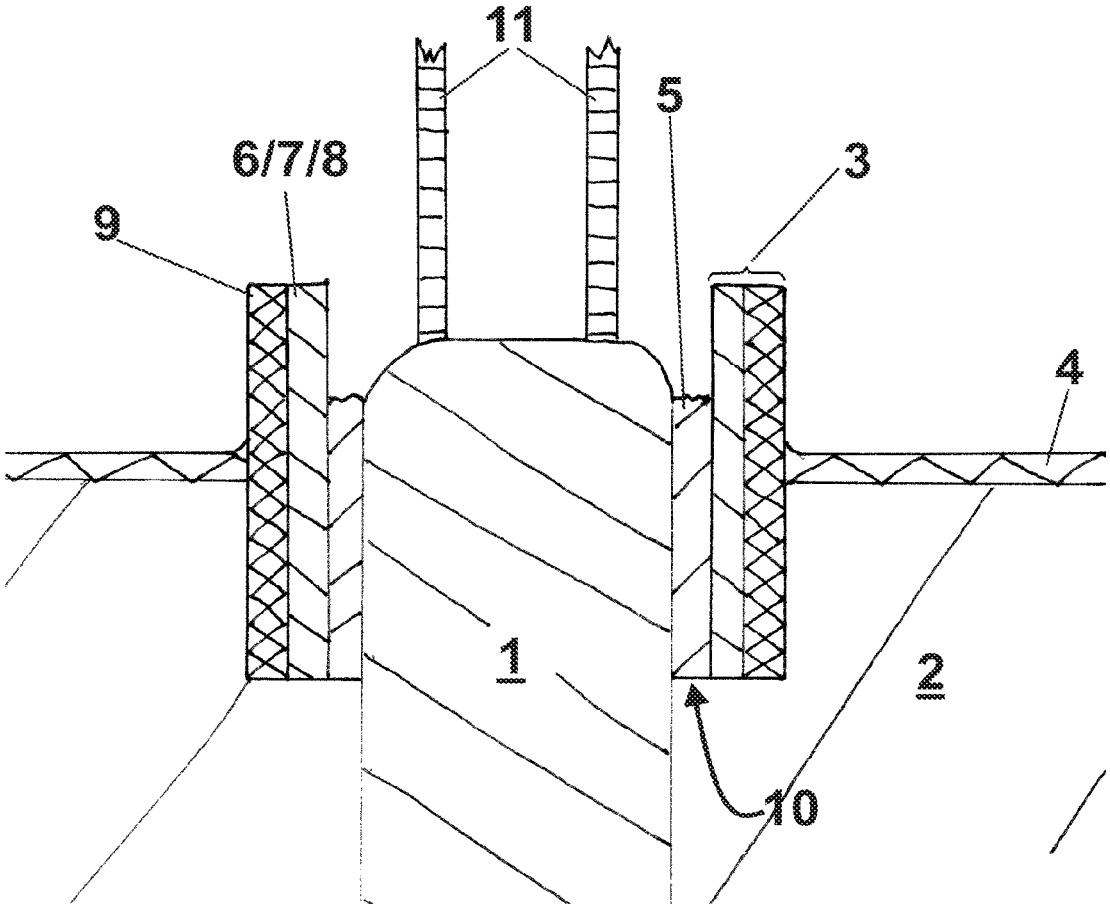

In FIGS. 1*a*, 1*b* and 1*c* is shown a lateral cross section through a sealed pile according to an exemplary method of the disclosure.

For example, the pile 1 is a pile in the field of construction, which is introduced into a foundation 2. Depending on the particular application, for example, the length, diameter, material and configuration of the piles can vary. For example, the pile can include materials such as wood, metal and hardened mineral binders, for example, hardened mineral binders, for example, concrete. The pile can have a length of, for example, 5-25 meters. The pile can have a diameter of, for example, 0.3-2 meters, for example, 0.6-1.2 meters.

For example, the pile is a bored pile. The pile 1 can furthermore contain support elements 11 at its end facing the barrier layer 4, which can be used, for example, for a broad distribution of the bearing load, or the anchoring load.

An exemplary method according to the disclosure comprises a step 1) of applying a barrier layer 4 to the foundation 2. The foundation 2 can be the ground. The foundation can be horizontal or not. For example, the foundation can be substantially horizontal.

The barrier layer 4 can be a geomembrane, for example, which is suitable to seal a structure against moisture from the foundation. The barrier layer can include a material that also provides an adequate tightness even at high liquid pressures. For example, the barrier layer has good resistance to water pressure, as well as good performance in the crack propagation tests and perforation tests.

For example, the barrier layer is a thermoplastic layer. For example, the barrier layer is chosen from high-density polyethylene (HDPE), medium-density polyethylene (MDPE), low-density polyethylene (LDPE), polyethylene (PE), polyethylene terephthalate (PET), polystyrene (PS), polyvinylchloride (PVC), polyamides (PA), ethylene-vinyl acetate (EVA), chlorosulfonated polyethylene, thermoplastic polyolefins (TPO), ethylene-propylene-diene rubber (EPDM) and mixtures thereof.

The barrier layer can have a thickness of 0.1-5 mm, for example, 0.5-3.5 mm, for example, 1.5-2.5 mm.

An exemplary method further comprises a step 2) of introducing the pile 1 into the foundation 2. This can occur before or after step 1). For example, the introducing is done by boring or ramming techniques in the foundation. Any suitable technique known to the skilled person can be employed.

The pile 1 can be arranged so that it penetrates the barrier layer 4. For example, this can be accomplished in that the barrier layer 4 is pierced by the pile when the pile 1 is introduced into the foundation 2. For example, it can also be accomplished by arranging the barrier layer on the foundation after the pile has been introduced into the foundation and the region of the foundation in which the pile has been placed is left free of the barrier layer. This can be accomplished, for example, in that cutouts are cut out from the barrier layer in these regions and the barrier layer is placed on the foundation such that the mentioned cutouts come to lie above the pile ends.

An exemplary method can comprise a step 3) of applying a hollow-body formwork element 3 along the central longitudinal axis of the pile 1, with the hollow-body formwork element surrounding the pile.

The part of the pile situated outside the foundation can be surrounded by the hollow-body formwork element along essentially the entire length, as shown in FIGS. 1*a* or 1*c*, or only a portion of its length, as shown in FIG. 1*b*, for example, along essentially the entire length. By "essentially the entire length" is meant, in the present case, that a region of, for example, a few centimeters or millimeters, along the longitudinal axis of the pile near the foundation is not surrounded by the hollow-body formwork element. For example, the hollow-body formwork element can be arranged on the barrier layer as shown in FIG. 1*a*, where the pile in the region corresponding to the thickness of the barrier layer in FIG. 1*a* is not surrounded by the hollow-body formwork element.

In the case when the part of the pile located outside the foundation is surrounded by the hollow-body formwork element along essentially the entire length, the pile can be entirely covered with mineral binder by introducing the mineral binder 5 into the intermediate region 12 between pile and hollow-body formwork element. This can help prevent seepage behind it.

An exemplary method further comprises a step 4) of application of mineral binder 5 in the intermediate region 12 between pile 1 and hollow-body formwork element 3. In an exemplary embodiment, the end of the pile 1 facing the barrier layer 4 can be covered essentially completely, for example, completely with mineral binder 5 in step 4). The hardened mineral binder can be coated afterwards with a layer of epoxy resin and thus seal it, for example, with a layer thickness of 0.5-5 cm, for example, 1-2 cm. This sealing can be suitable both for the case when the part of the pile located outside of the foundation is surrounded by the hollow-body formwork element along essentially the entire length, and for exemplary embodiments when this is the case only on a portion of its length.

The mineral binders can include hydraulic binders and/or latent hydraulic binders and/or puzzolanic binders. By the term hydraulic binder is meant in the present document binders that also bind, or harden, under water, such as hydraulic lime or cement. By the term latent hydraulic binders is meant in the present document binders that only bind, or harden, due to the action of additives (activators), such as blast furnace slag. By the term puzzolanic binders is meant in the present document binders that do not themselves bind, but provide strength-forming reaction products after moist storage by binding of calcium hydroxide, such as fly ash, silica fume, as well as natural puzzolans such as trass.

The mineral binders can be cement-based binders, for example, high-strength grouting mortar. They can be introduced by pouring. Any suitable method known to the skilled person can be employed.

The mineral binder introduced into the intermediate region 12 in step 4) can remain there and harden there.

The mineral binder 5 introduced in step 4) can bind substantially firmly to the contact layer 6 and, for example, prevent seeping water 10 of the foundation from getting in behind the hollow-body formwork element 3.

As is evident, for example, from FIGS. 1*a*, 1*b* and 1*c*, the hollow-body formwork element can have a contact layer 6 on the side facing the pile. The contact layer 6 comprises a composite layer 7 of a porous material and/or a sealant 8.

The composite layer can include any suitable material, for example, those that are readily penetrated by liquid mineral binders, for example, concrete, and form a good composite with the hardened mineral binder.

By the term "composite layer" is meant in this document a layer that can form a composite with the applied mineral binder.

Thus, the composite layer can enter into a substantially firm composite with the mineral binder, for example, when said mineral binder is brought into contact with the composite layer before it hardens.

The composite layer can include a porous mineral. A porous structure can be beneficial to the elasticity of the composite layer, so that it can better withstand tensile and shear forces. On the other hand, it can lead to a good uptake of liquid mineral binders and thus to a good composite with the liquid and the hardened mineral binder.

For example, the composite layer is a fibrous material. By fibrous material is meant in the entire present document a material that is composed of fibers. The fibers comprise organic or synthetic material. For example, this can include cellulose, cotton, protein fibers or synthetic fibers. As the synthetic fibers, exemplary are fibers of polyester or a homo- or copolymers of ethylene and/or propylene or rayon. The fibers can be short fibers or long fibers, spun, woven or unwoven fibers or filaments. Furthermore, the fibers can be orientated or stretched fibers. For example, fibers of different geometry as well as composition can be used together with each other.

Furthermore, the fiber material can comprise voids. These voids can be made by suitable manufacturing methods. For example, the voids are at least partly open and allow liquid mineral binders to get in.

The body composed of fibers can be made by any suitable method known to the skilled person. For example, bodies that are a woven fabric, laid fabric or knitted fabric can be used.

A felt or fleece is an example of the fiber material.

The composite layer can be a thermoplastic material. The material can comprise high-density polyethylene (HDPE), polyethylene terephthalate (PET), polystyrene (PS), polypropylene (PP), polyvinylchloride (PVC), polyamide (PA) and combinations thereof.

For example, the composite layer 7 can have a thickness of 0.5-30 mm, for example, 2-10 mm.

As the sealant 8, any material which is suitable to reduce or prevent the penetration of liquids, for example, water, between the hardened mineral binder and the hollow-body formwork element, can be employed.

For example, the sealant is a thermoplastic or a thermoplastic elastomer. Thermoplastic elastomers can have the advantage that the sealant has good elasticity with respect to horizontal and vertical displacements, for example, displacements caused by mechanical stresses in the structure. A good elasticity of the sealant can prevent cracking or peeling of the sealant and thus a failure of the seal.

By thermoplastic elastomer is meant in this document plastics which combine the mechanical properties of vulcanized elastomers with the processing ease of thermoplastics. For example, such thermoplastic elastomers can include block copolymers with hard and soft segments or so-called polymer alloys with corresponding thermoplastic and elastomer components.

Other exemplary sealants include sealants chosen from acrylate compounds, polyurethane polymers, silane-terminated polymers and polyolefins.

For example, the sealant 8 can be a pressure-sensitive adhesive and/or a hot-melt glue. This can ensure a good composite and a good adhesion between mineral binder and the hollow-body formwork element and thus can lessen the peeling of the sealant and thus a failure of the seal.

Any suitable pressure-sensitive adhesive and hot-melt glue known to the skilled person can be used, for example, such as that described in CD Römpp Chemie Lexikon, version 1.0, Georg Thieme Press, Stuttgart.

The sealant can contain bulking agents which upon contact with water increase their volume many times over, for example, between 200-1000% of the original volume. For example, in addition to the volume increase, the bulking agent can also react chemically with water. Examples of such bulking agents are those based on polyurethane, for example, silane-modified polymers that harden by moisture into an elastic product. Another example of a bulking agent is a bentonite butyl rubber.

For example, the bulking agents can react with water in a time delay when applied in a coat, so that, for example, during the contact with moist mineral binder the bulking agents do not swell or do so only slightly and they remain able to swell in the event of seeping water 10 getting in behind the hollow-body sealing element.

The sealant can have a thickness of 0.5-30 mm, for example, 2-10 mm.

The hollow-body formwork element 3 can have at least one injection hose, which is arranged on the side of the hollow-body formwork element 3 facing the pile 1. For example, due to the injection hose, in the event of seeping water 10 of the foundation getting in behind the hollow-body formwork element 3, suitable injection materials such as acrylate compounds, polyurethane polymers, or cement can still be introduced after the hardening of the mineral binder and thus limit or prevent any seepage.

The hollow-body formwork element 3 can have a supporting layer 9 of metal, for example, steel, or a plastic, for example, a thermoplastic, which is chosen from high-density polyethylene (HDPE), medium-density polyethylene (MDPE), low-density polyethylene (LDPE), polyethylene (PE), polyethylene terephthalate (PET), polystyrene (PS), polyvinylchloride (PVC), polyamides (PA), ethylene-vinyl acetate (EVA), chlorosulfonated polyethylene, thermoplastic polyolefins (TPO), and ethylene-propylene-diene rubber (EPDM).

For example, the supporting layer 9 has a thickness of 0.2-5 mm. For example, in the event that it is a supporting layer of metal, it can have a thickness of 0.6-2 mm. For example, in the event that it is a supporting layer of plastic, it can have a thickness of 0.5-5 mm.

For example, during or after step 4), the hollow-body formwork element 3 can be essentially not curved or bent, for example, not curved or bent. This can be advantageous because one can then, for example, guarantee a controlled fill height and dimension of the formwork element filled with mineral binder. For example, this can limit or prevent damage of the formwork element by the forces created by the weight of the binder.

The hollow-body formwork element 3 can have a height of, for example, 2-50 cm, for example, 5-30 cm.

The hollow-body formwork element 3 can be arranged essentially on the side of the barrier layer 4 that is away from the foundation 2. This exemplary arrangement is shown in FIGS. 1*a* and 1*b*. The hollow-body formwork element can also be arranged on both sides of the barrier layer 4 (for example, on both the side that is away from the foundation 2 as well as the side that is facing the foundation 2). This exemplary arrangement is shown in FIG. 1*c*.

For example, the hollow-body formwork element 3 can be arranged essentially on the side of the barrier layer 4 away from the foundation 2. By "essentially on the side of the barrier layer 4 away from the foundation 2" is meant in the present instance that more than 80%, for example, more than 90%, for example, more than 95% of the height of the hollow-body formwork element is arranged on the side of the barrier layer 4 away from the foundation 2. In an exemplary embodiment, the hollow-body formwork element 3 can be arranged completely on the side of the barrier layer 4 away from the foundation 2.

An exemplary method comprises the step 5) of connecting the barrier layer 4 and hollow-body formwork element 3. The connecting can occur in any form and manner which assures an essentially water-tight connection between barrier layer 4 and hollow-body formwork element 3. For example, the connecting can be done by welding and/or gluing and/or mechanical joining. Step 5) can be performed before or after step 4). For example, step 5) is performed after step 4).

For example, the hollow-body formwork element has at least one connection element 13, which connects the hollow-body formwork element 3 to the barrier layer 4, as is shown in FIGS. 1*a* and 1*b*. The connection element can be a band encircling the hollow-body formwork element, which is placed thereon and directed radially outward. The band can have a width of 2-50 cm, for example, 5-30 cm. The band and can have a thickness of 0.2-5 mm.

For example, in step 5), the connecting of barrier layer 4 and hollow-body formwork element 3 is performed by welding and/or gluing and/or mechanical joining of the connection element 13 and barrier layer 4. For example, the connecting results in an overlap region of connection element and barrier layer of 2-15 cm. The connection element can be arranged on the edge of the hollow-body formwork element facing the barrier layer, as can be seen, for example, in FIGS. 1*a* and 1*b*.

The hollow-body formwork element 3 can be a hollow body with two openings, for example, a cylindrical hollow body, for example, an essentially circular cylindrical hollow body, for example, a circular cylindrical hollow body.

Figure 3A:
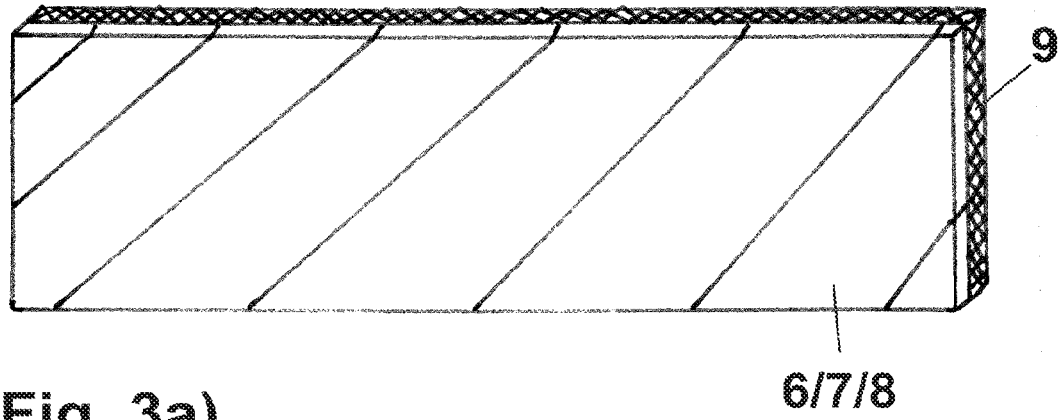
FIGS. 3*a* and 3*b* show lateral front views of a sheetlike body before (3*a*) and after (3*b*) being shaped into a hollow-body formwork element by sideways overlapping on itself, according to an exemplary aspect.
Figure 3B:
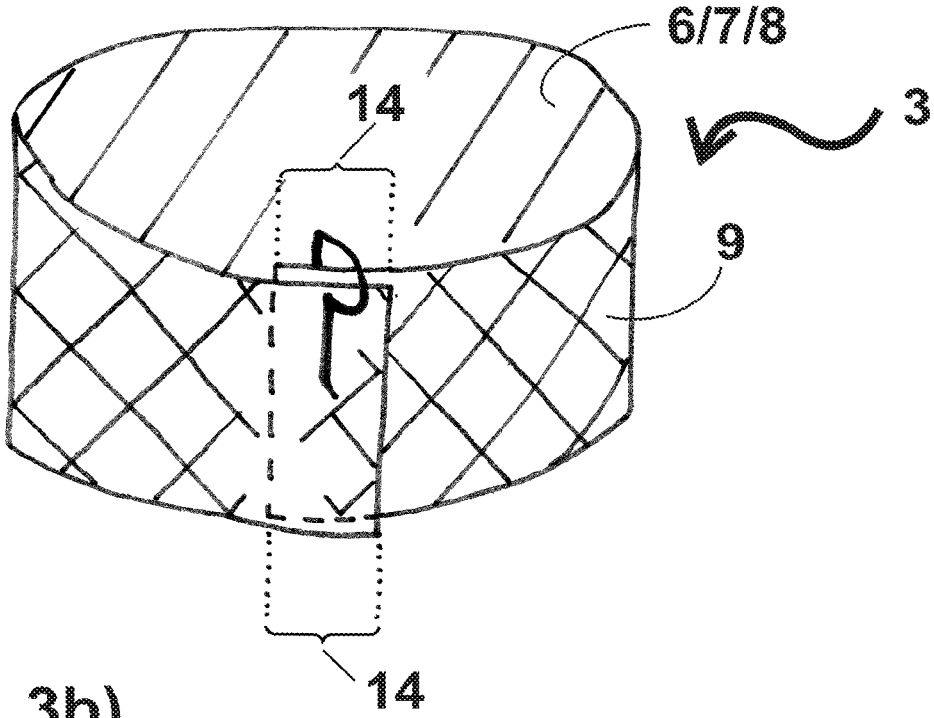

For example, the hollow-body formwork element 3 is a hollow body made by deep drawing or extrusion, as is shown in FIG. 2, or a curved sheetlike body which is overlapped in its longitudinal direction. FIG. 3*a* shows one possible sheetlike body before, and FIG. 3*b* after the shaping into a hollow-body formwork element by lateral overlapping onto itself. The sheetlike body can be joined to itself in the overlap region 14 in various ways to form a hollow body, for example, by gluing or mechanical connection means. For example, the overlap region is secured with at least one clamplike retaining element, as is shown in FIG. 3*b*.

For example, the overlap region 14 is 2-30 cm, measured from the axial lengthwise edges in the longitudinal direction along the sheetlike body.

For example, if the hollow-body formwork element 3 is not removed after the hardening of the mineral binder introduced in step 4), this can provide an exemplary advantage that the exemplary method can eliminate the removal of the formwork and thus an additional work step, since the hollow-body formwork element remains as part of the structure and performs a sealing function.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 pile
2 foundation
3 hollow-body formwork element
4 barrier layer
5 mineral binder
6 contact layer
7 composite layer
8 sealant
9 supporting layer
10 seeping water
11 support element
12 intermediate region between pile and hollow-body formwork element
13 connection element
14 overlap region

What is claimed is:

1. A method for sealing a pile in a foundation in a construction field by using a hollow-body formwork element, the method comprising:

applying a barrier layer to a foundation;

introducing a pile into the foundation, the pile being arranged so as to penetrate the barrier layer;

applying a hollow-body formwork element along the central longitudinal axis of the pile, the hollow-body formwork element surrounding at least a part of the pile;

introducing a mineral binding agent into an intermediate space between the pile and the hollow-body formwork element; and connecting the barrier layer and the hollow-body formwork element;

wherein the hollow-body formwork element has on a side facing the pile a contact layer which comprises a composite layer of a porous material and/or a sealant;

wherein the hollow-body formwork element has a supporting layer of a metal or a plastic; and wherein the supporting layer has a thickness of 0.2-5 mm.

2. The method according to claim 1, wherein the hollow-body formwork element is arranged essentially on the side of the barrier layer away from the foundation.

3. The method according to claim 1, wherein in the step of introducing the mineral binding agent into the intermediate space between the pile and the hollow-body formwork element, the end of the pile facing the barrier layer is covered essentially completely with mineral binder.

4. The method according to claim 1, wherein during or after the step of introducing the mineral binding agent into the intermediate space between the pile and the hollow-body formwork element, the hollow-body formwork element is essentially not curved or bent.

5. The method according to claim 1, wherein the hollow-body formwork element has a height of 2-50 cm.

6. The method according to claim 1, wherein the mineral binding agent is hardened, and the hollow-body formwork element is not removed after the hardening of the mineral binding agent.

7. The method according to claim 1, wherein the mineral binding agent is joined to the contact layer.

8. The method according to claim 7, wherein the mineral binding agent is joined to the contact layer such that the mineral binding agent prevents seeping water of the foundation from getting in behind the hollow-body formwork element.

9. The method according to claim 1, wherein the hollow-body formwork element is a cylindrical hollow body.

10. The method according to claim 1, wherein:

the hollow-body formwork element is a hollow body made by deep drawing or extrusion, or the hollow-body formwork element is a curved sheet-shaped body which overlaps in its longitudinal direction.

11. The method according to claim 10, wherein the hollow-body formwork element is a curved sheet-shaped body, wherein ends of the curved sheet-shaped body overlap in a longitudinal direction of the curved sheet-shaped body.

12. The method according to claim 11, wherein an overlap region is 2-30 cm, measured from the axial lengthwise edges in the longitudinal direction along the sheet-shaped body.

13. The method according to claim 11, wherein an overlap region is secured with at least one retaining element.

14. The method according to claim 13, wherein the step of connecting the barrier layer and the hollow-body formwork element is performed by welding and/or gluing and/or mechanical joining of the connection element and the barrier layer.

15. The method according to claim 1, wherein the hollow-body formwork element has at least one connection element.

16. The method according to claim 15, wherein the at least one connection element is arranged at the edge of the hollow-body formwork element facing the barrier layer, wherein the at least one connection element connects the hollow-body formwork element to the barrier layer.

17. The method according to claim 1, wherein the hollow-body formwork element has at least one injection hose which is arranged on the side of the hollow-body formwork element facing the pile.

18. The method according to claim 1, wherein the pile comprises a support element and concrete.

19. The method according to claim 1, wherein the composite layer comprises a fibrous material or a thermoplastic material.

20. The method according to claim 1, wherein the composite layer comprises the porous material which is a fibrous material.

21. The method according to claim 1, wherein the hollow-body formwork element has a supporting layer of a metal.

22. A method for sealing a pile in a foundation in a construction field by using a hollow-body formwork element, the method comprising:

applying a barrier layer to a foundation;

introducing a pile into the foundation, the pile being arranged so as to penetrate the barrier layer;

applying a hollow-body formwork element along the central longitudinal axis of the pile, the hollow-body formwork element surrounding at least a part of the pile;

introducing a mineral binding agent into an intermediate space between the pile and the hollow-body formwork element; and connecting the barrier layer and the hollow-body formwork element;

wherein the hollow-body formwork element has on a side facing the pile a contact layer which comprises a composite layer of a porous material and/or a sealant, and wherein the composite layer has a thickness of 0.5-30 mm.

23. A method for sealing a pile in a foundation in a construction field by using a hollow-body formwork element, the method comprising:

applying a barrier layer to a foundation;

introducing a pile into the foundation, the pile being arranged so as to penetrate the barrier layer;

applying a hollow-body formwork element along the central longitudinal axis of the pile, the hollow-body formwork element surrounding at least a part of the pile;

introducing a mineral binding agent into an intermediate space between the pile and the hollow-body formwork element; and connecting the barrier layer and the hollow-body formwork element;

wherein the hollow-body formwork element has on a side facing the pile a contact layer which comprises a composite layer of a porous material and/or a sealant, and wherein the entirety of the formwork element is arranged above the barrier layer.

* * * * *